US006565487B1

(12) United States Patent
Kuo

(10) Patent No.: US 6,565,487 B1
(45) Date of Patent: May 20, 2003

(54) EXERCISER HAVING A FORWARD AND REARWARD ADJUSTING SEAT

(76) Inventor: Hai Pin Kuo, No. 158, Sec. 1, Er Jen Road, Jen Teh Hsiang, Tainan Hsien (TW), 717

( * ) Notice: Subject to any disclaimer, the term of this patent is extended or adjusted under 35 U.S.C. 154(b) by 413 days.

(21) Appl. No.: 09/617,771

(22) Filed: Jul. 17, 2000

(51) Int. Cl.[7] ..... A63B 69/16

(52) U.S. Cl. ..... 482/57; 280/226.1; 297/195.1; 267/132

(58) Field of Search ..... 482/51, 57, 58–65; 280/220, 226.1, 283; 297/195.1, 196; 267/132, 133

(56) References Cited

U.S. PATENT DOCUMENTS 3,314,672 A * 4/1967 Persson ..... 267/131
5,346,235 A * 9/1994 Holman ..... 280/226.1
5,489,139 A * 2/1996 McFarland ..... 297/195.1
5,833,255 A * 11/1998 Sarder et al. ..... 280/220
6,089,656 A * 7/2000 Hals ..... 297/215.13
6,409,130 B1 * 6/2002 Maret ..... 248/219.2

* cited by examiner

*Primary Examiner*—Nicholas D. Lucchesi
*Assistant Examiner*—Tam Nguyen
(74) *Attorney, Agent, or Firm*—Charles E. Baxley

(57) ABSTRACT

An exerciser includes a base having a handle and having a post for supporting a seat which is secured on and supported on a support. A pair of bars have the lower ends pivotally secured to the post and have the upper ends pivotally secured to the support, such that the support and thus the seat may be adjusted forwardly and rearwardly relative to the post and the handle with the bars. A lock rod is engaged through the support and one of the bars for locking the support to the bars. The bars each has a stop engaged with the support for sustaining the support and the seat in place.

9 Claims, 6 Drawing Sheets

EXERCISER HAVING A FORWARD AND REARWARD ADJUSTING SEAT

BACKGROUND OF THE INVENTION

1. Field of the Invention

The present invention relates to an exerciser, and more particularly to an exerciser having a seat that may be adjusted laterally, such as be adjusted forward or rearward.

2. Description of the Prior Art

Typical exercisers, such as the cycling exercisers comprise a handle for supporting the upper portion of the user and a seat for supporting the lower portion of the user. The seats of the typical exercisers may only be adjusted upward and downward according to the heights of the users, and may not be adjusted forward toward the handle or be adjusted rearward away from the handle, such that the seat may not be adjusted to the best working or exercising position for the users.

The present invention has arisen to mitigate and/or obviate the afore-described disadvantages of the conventional seats for exercisers.

SUMMARY OF THE INVENTION

The primary objective of the present invention is to provide an exerciser including a seat that may be adjusted laterally, such as be adjusted forwardly and/or rearwardly toward and/or away from the handle for allowing the seat to be adjusted to the best working or exercising position for the users.

In accordance with one aspect of the invention, there is provided an exerciser comprising a base including a front portion having a handle provided thereon, and including a middle portion having a post provided thereon, a seat provided on the post, and an adjusting means for adjusting the seat forwardly and rearwardly relative to the post. The seat may thus be adjusted forwardly and/or rearwardly relative to the post and toward and/or away from the handle for allowing the seat to be adjusted to the best working or exercising position for the users. The seat is thus particularly suitable for the children to adjust toward the handle for suitably conducting the exercises with the exerciser.

The post includes a front portion and a rear portion, the adjusting means includes a support for supporting the seat and having a front portion and a rear portion, and a first bar and a second bar each including a lower portion rotatably secured to the front portion and the rear portion of the post respectively with a shaft and each including an upper portion rotatably secured to the front portion and the rear portion of the support respectively with an axle, for adjusting the seat forwardly and rearwardly relative to the post with the first and the second bars.

The adjusting means includes a locking means for locking the first and the second bars relative to the post. The locking means includes a rod engaged through the support and the second bar for locking the support to the second bar. The support includes a barrel provided thereon, the second bar includes a first plate and a second plate, the locking means includes a rod slidably engaged through the first plate and the barrel and selectively engaged with the second plate to lock the support to the second bar.

The rod includes a stud having a diameter smaller than that of the rod, the first plate includes a slot formed therein for slidably receiving the stud of the rod, the first plate includes a first orifice and at least one second orifice formed therein and communicating with the slot of the first plate for selectively receiving the rod.

The second plate includes a first aperture and at least one second aperture formed therein and aligned with the first orifice and the second orifice of the first plate, the rod includes a latch for selectively engaging with the first aperture and at least one second aperture of the second plate. A biasing device is further provided for biasing the latch to selectively engage with the first aperture and at least one second aperture of the second plate.

The first bar and the second bar each includes a stop provided thereon for engaging with the barrel of the support or for directly engaging with the support and for sustaining the support with the first bar and the second bar. The support includes a board secured thereon and secured to the seat for supporting the seat on the support.

The base includes a tube provided on the middle portion thereof, the post is slidably received in the tube and adjustable relative to the tube, and the tube includes means for adjustably securing the post to the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
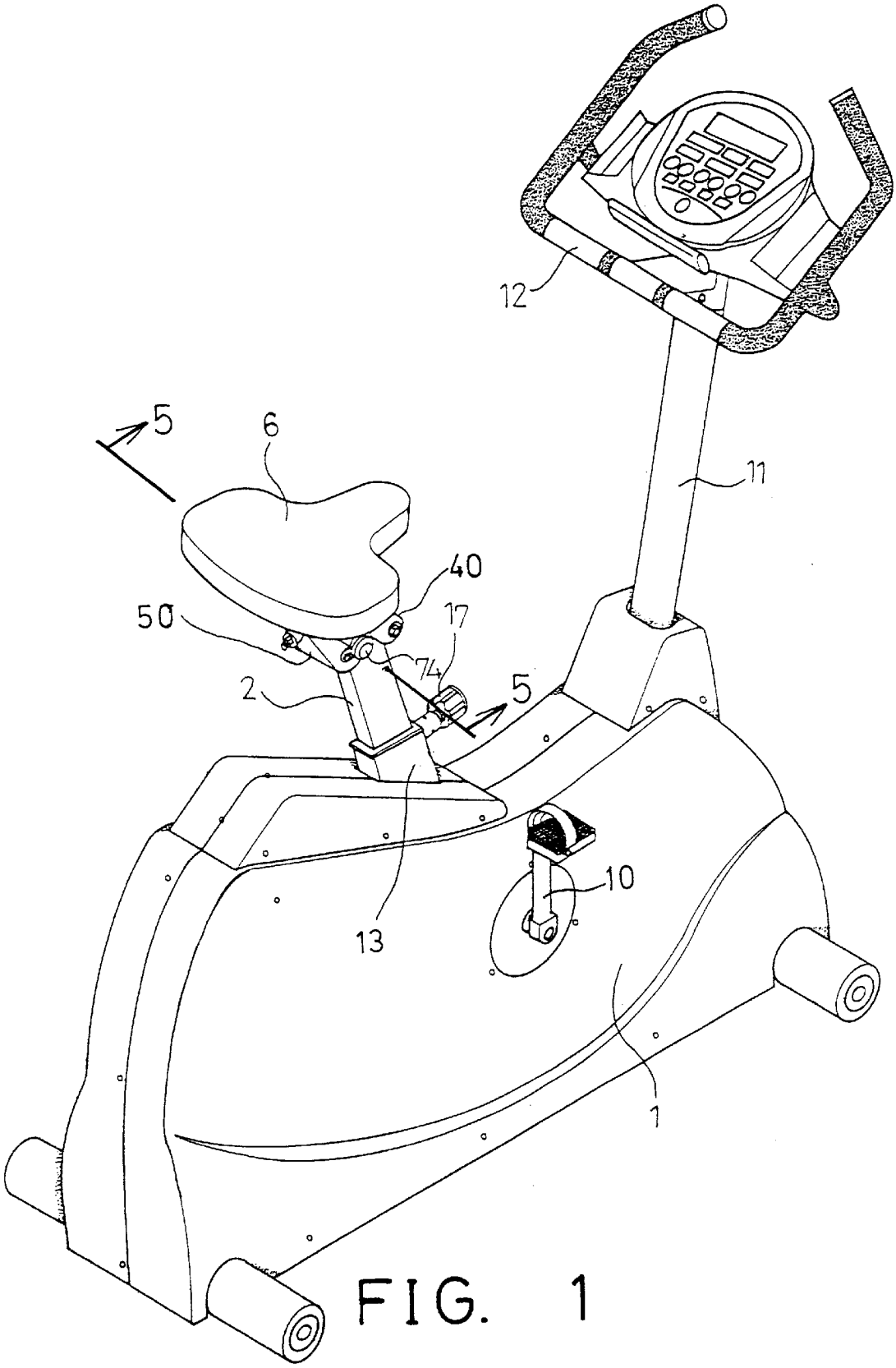
FIG. 1 is a perspective view of an exerciser in accordance with the present invention.

Referring to the drawings, and initially to FIGS. 1–4, an exerciser in accordance with the present invention comprises a pair of typical foot pedals 10 secured to a base 1 with cranks for cycling purposes. A pole 11 is extended upward from the front portion of the base 1 for supporting a handle 12 thereon, in which the pole 11 may include a solid structure or a foldable structure for allowing the handle 12 to be adjusted upwardly and downwardly. A tube 13 is extended upward from the middle or rear portion of the base 1 for supporting a seat cushion or a seat 6. The seat 6 may include a post 2 slidably engaged in the tube 13 and selectively secured to the tube 13 with a fastener 17 for adjusting the height of the seat 6 relative to the base 1.

Figure 4:
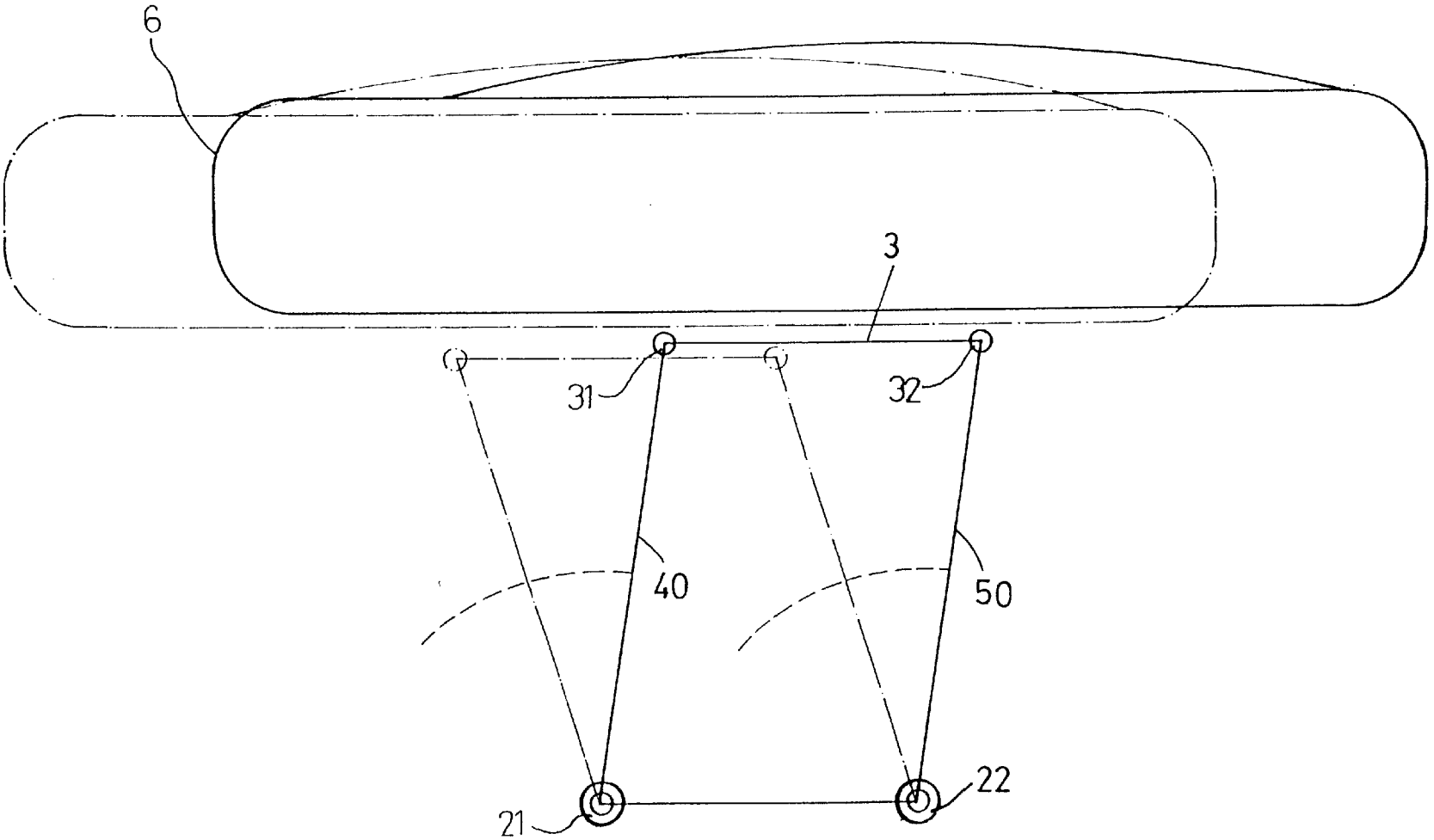
FIG. 4 is a schematic view illustrating the movement or the operation of the seat of the exerciser.

The seat 6 includes one or more fasteners 61 extended downward therefrom and engaged through the holes 341 of a board 34 for securing the seat 6 to the board 34 with the fasteners 61 and the washers 15 and the lock nuts 35. The post 2 includes an upper portion 20 having a hub 21 provided in the front portion thereof and another hub 22 provided in the rear portion thereof. A pair of bars 40, 50 each includes a pair of plates 41, 51 extended therefrom and preferably parallel to each other. The plates 41, 51 have a lower portion 412, 512 rotatably secured to the front and the rear portions 21, 22 of the post 2 respectively with the washers 15 and/or the collars 16 and/or the fasteners or shafts 414, 518, such that the bars 40, 50 may be rotatably secured to the post 2 with the pivot shafts 414, 518 respectively. A support 3 includes a front portion 31 and a rear portion 32 rotatably secured to the upper portions 411, 511 of the bars 40, 50 respectively with the washers 15 and/or the collars 16 and/or the fasteners or axles 413, 517, such that the bars 40, 50 may be rotatably secured to the support 3 with the pivot axles 413, 517 respectively and such that the support 3 may be rotatably or pivotally coupled between the upper portions of the bars 40, 50, and such that the seat 6 may be adjusted forwardly and rearwardly by the bars 40, 50 (FIG. 4). A stay or an arm 37 may be provided between the board 34 and the support 3 for supporting the board 34 and thus the seat 6 upon the support 3.

One of the plates or a first plate 51 of the bar 50 includes a slot 513 formed therein and includes one or more orifices 514 formed therein and communicating with the slot 513. The orifices 514 of the first plate 51 includes a size or a diameter greater than that of the slot 513. The other or the second plate 51 of the bar 50 includes one or more apertures 515 formed therein and arranged or aligned with the orifices 514 of the first plate 51. The support 3 includes a barrel 33 provided thereon, such as secured to the lower portion of the support 3 with an extension. A rod 7 is slidably received in the barrel 33, and includes a peripheral groove formed in the middle portion thereof for defining a stud 71 that has a size or a diameter smaller than that of the rod 7. The rod 7 includes a head or a knob 74 secured to one end thereof for moving the rod 7 relative to the barrel 33 of the support 3. The barrel 33 includes a chamber 38 (FIGS. 5, 6) formed therein and faced toward the second plate 51, for slidably receiving a latch 73 therein which is secured to the other end of the rod 7 with such as a threaded engagement. A spring 72 is engaged on the rod 7 and engaged between the barrel 33 and the latch 73 for biasing the latch 73 to engage with either of the apertures 515 of the second plate 51 and thus to secure the support 3 to the bar 50.

Figure 2:
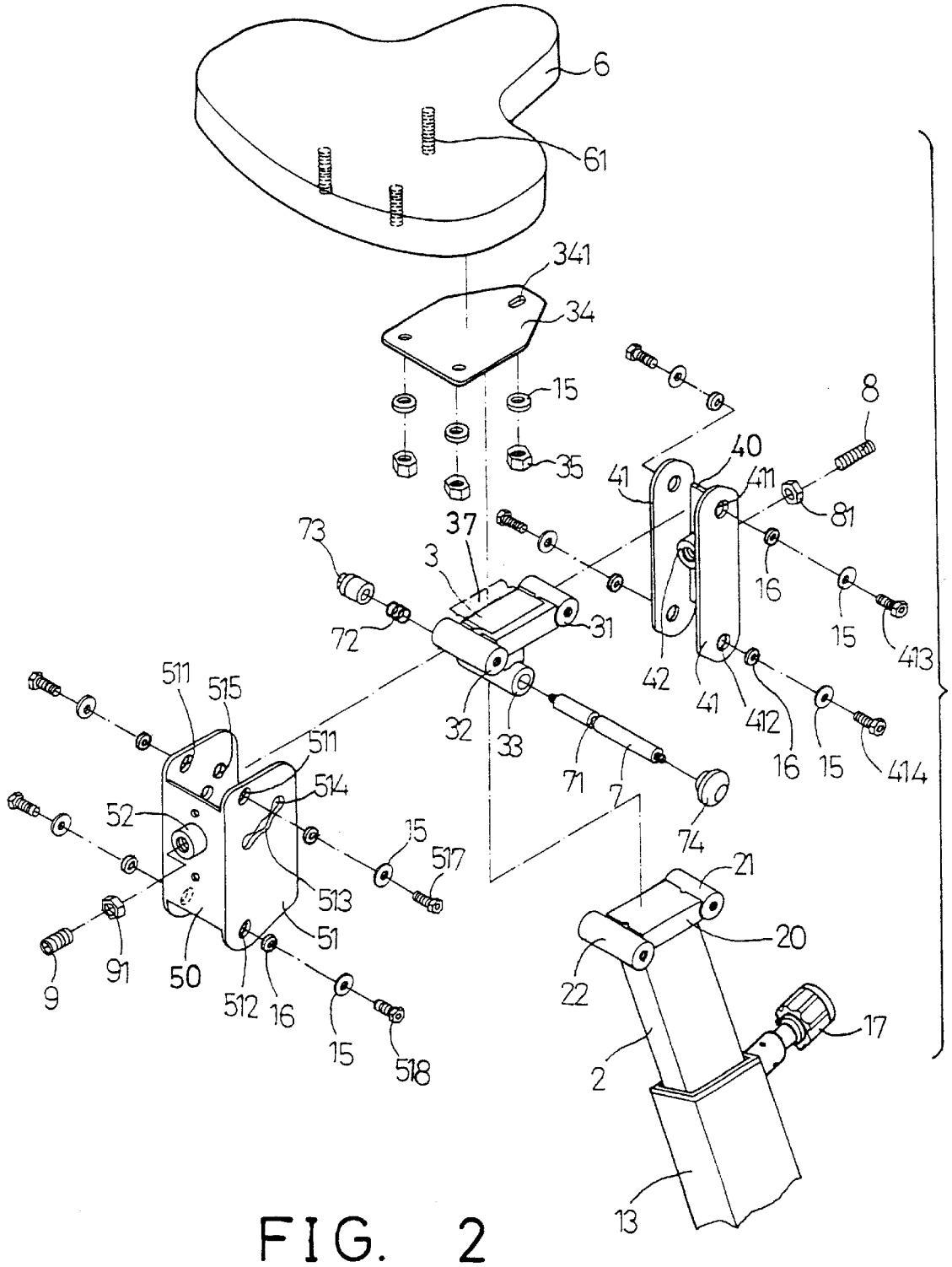
FIG. 2 is an exploded view of the seat of the exerciser.
Figure 3:
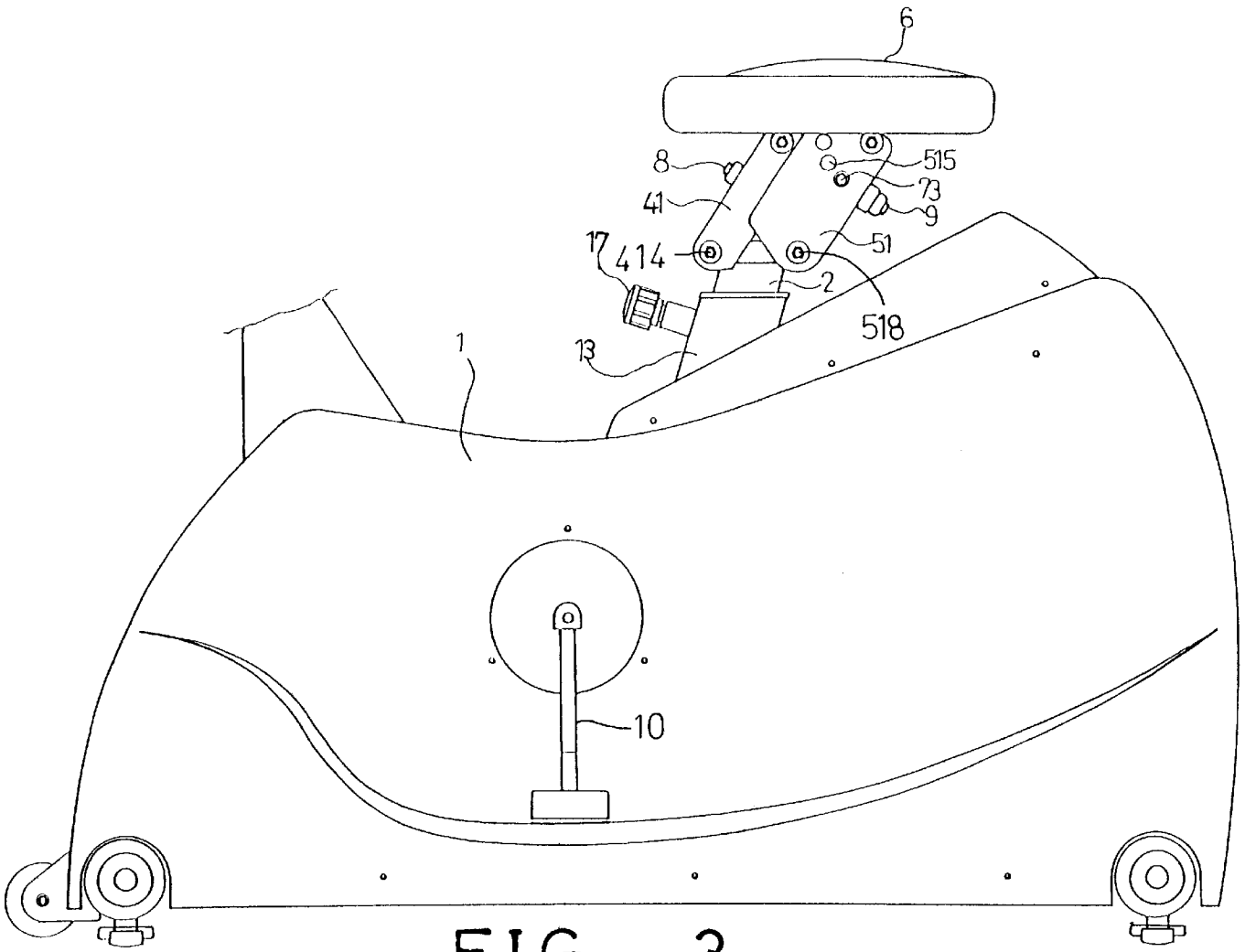
FIG. 3 is a partial side view of the exerciser for showing the seat of the exerciser.
Figure 6:
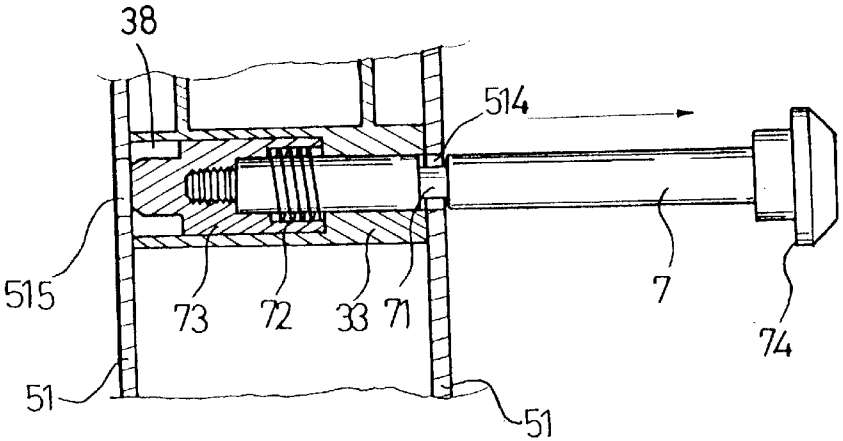
FIG. 6 is a cross sectional view similar to FIG. 5, illustrating the adjustment of the seat.
Figure 5:
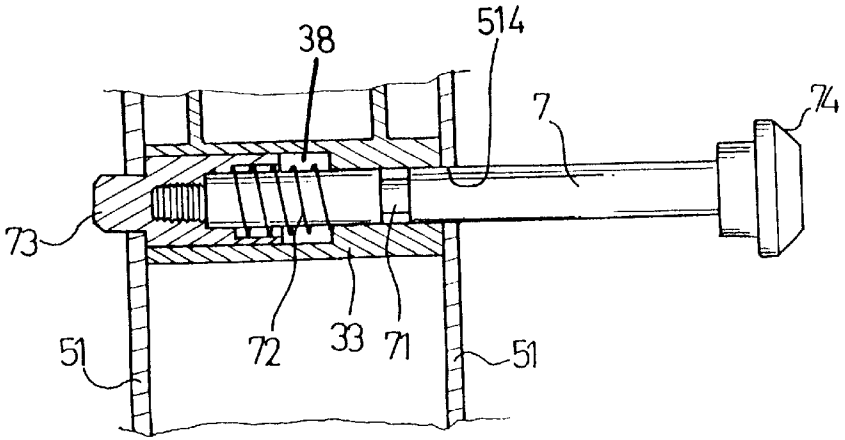
FIG. 5 is a partial cross sectional view taken along lines 5—5 of FIG. 1.
Figure 9:
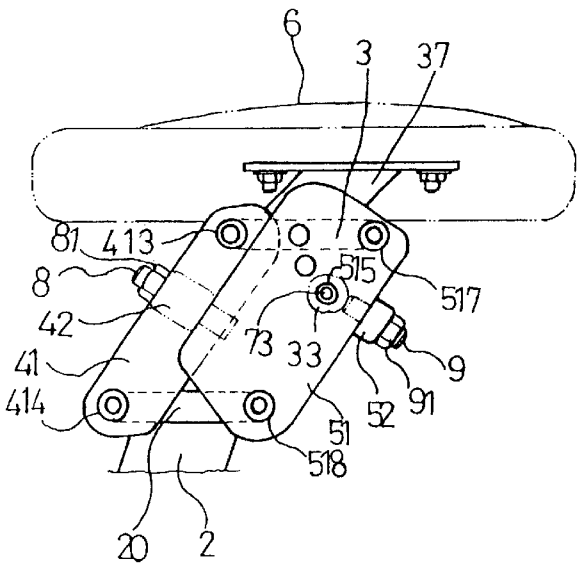
FIGS. 7, 8, 9 are partial side views illustrating the operation of the seat of the exerciser.
Figure 7:
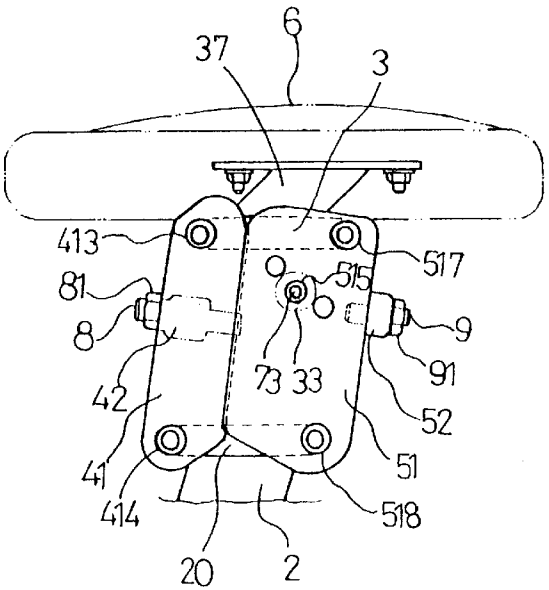
Figure 8:
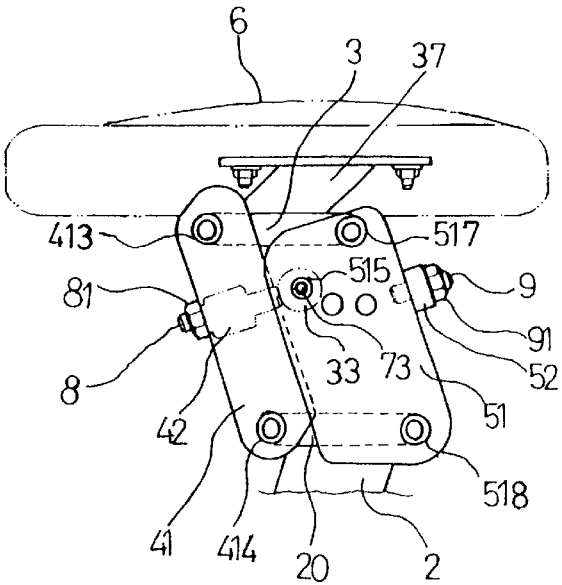

As best shown in FIGS. 2, 5, 6, the rod 7 has a size or a diameter no greater than that of the orifices 514, and greater than that of the slot 513 of the first plate 51, such that the rod 7 may not be slided along the slot 513, but may be received in either of the orifices 514 of the first plate 51. The stud 71 of the rod 7 has a size or a diameter smaller than that of the rod 7 and no greater than that of the slot 513 of the first plate 51, such that the stud 71 of the rod 7 may be slided and moved along the slot 513 of the first plate 51 until the rod 7 is engaged into either of the orifices 514 of the first plate 51. When the rod 7 is engaged into one of the orifices 514 of the first plate 51, the latch 73 may also be biased to engage into the corresponding aperture 515 of the second plate 51, such that the barrel 33 of the support 3 may be solidly secured to the bar 50 with the rod 7 and the latch 73. As shown in FIGS. 7–9, the seat 6 may thus be adjusted forwardly and rearwardly relative to the post 2 and may be solidly secured to the bar 50, such that the bars 40, 50 and the support 3 and thus the seat 6 may be solidly secured to the post 2 at the selected or adjusted forward or rearward position.

Referring particularly to FIGS. 2 and 7–9, the bars 40, 50 each includes a hub 42, 52 provided in the middle portion for threadedly receiving a fastener or a stop 8, 9 which may be locked to the bars 40, 50 with a lock nut 81, 91. The stops 8, 9 may be adjusted relative to the bars 40, 50 for engaging with the barrel 33 of the support 3 (FIGS. 8, 9) and for further solidly retaining the bars 40, 50 and thus the seat 6 at the selected or adjusted forward or rearward position.

Accordingly, the exerciser in accordance with the present invention includes a seat that may be adjusted laterally, such as be adjusted forwardly and/or rearwardly toward and/or away from the handle for allowing the seat to be adjusted to the best working or exercising position for the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a handle provided thereon, and including a middle portion having a post provided thereon, said post including a front portion and a rear portion, a seat provided on said post, adjusting means for adjusting said seat forwardly and rearwardly relative to said post, said adjusting means including a support for supporting said seat and having a front portion and a rear portion, and a first bar and a second bar each including a lower portion rotatably secured to said front portion and said rear portion of said post respectively with a shaft and each including an upper portion rotatably secured to said front portion and said rear portion of said support respectively with an axle, for adjusting said seat forwardly and rearwardly relative to said post with said first and said second bars, and a locking means for locking said first and said second bars relative to said post, said locking means including a rod engaged through said support and said second bar for locking said support to said second bar.

2. An exerciser comprising:

a base including a front portion having a handle provided thereon, and including a middle portion having a post provided thereon, said post including a front portion and a rear portion, a seat provided on said post, adjusting means for adjusting said seat forwardly and rearwardly relative to said post, said adjusting means including a support for supporting said seat and having a front portion and a rear portion, and a first bar and a second bar each including a lower portion rotatably secured to said front portion and said rear portion of said post respectively with a shaft and each including an upper portion rotatably secured to said front portion and said rear portion of said support respectively with an axle, for adjusting said seat forwardly and rearwardly relative to said post with said first and said second bars, said support including a barrel provided thereon, said second bar including a first plate and a second plate, and a locking means for locking said first and said second bars relative to said post, said locking means including a rod slidably engaged through said first plate and said barrel and selectively engaged with said second plate to lock said support to said second bar.

3. The exerciser according to claim 2, wherein said rod includes a stud having a diameter smaller than that of said rod, said first plate includes a slot formed therein for slidably receiving said stud of said rod, said first plate includes a first orifice and at least one second orifice formed therein and communicating with said slot of said first plate for selectively receiving said rod.

4. The exerciser according to claim 3, wherein said second plate includes a first aperture and at least one second aperture formed therein and aligned with said first orifice and said at least one second orifice of said first plate, said rod includes a latch for selectively engaging with said first aperture and at least one second aperture of said second plate.

5. The exerciser according to claim 4, further comprising means for biasing said latch to selectively engage with said first aperture and at least one second aperture of said second plate.

6. The exerciser according to claim 2, wherein said first bar and said second bar each includes a stop provided thereon for engaging with said barrel of said support and for sustaining said support with said first bar and said second bar.

7. The exerciser according to claim 2, wherein said first bar and said second bar each includes a stop provided thereon for engaging with said support and for sustaining said support with said first bar and said second bar.

8. The exerciser according to claim 2, wherein said support includes a board secured thereon and secured to said seat for supporting said seat on said support.

9. The exerciser according to claim 2, wherein said base includes a tube provided on said middle portion thereof, said post is slidably received in said tube and adjustable relative to said tube, and said tube includes means for adjustably securing said post to said tube.

* * * * *